US009265326B2

(12) United States Patent
Gatesoupe et al.

(10) Patent No.: US 9,265,326 B2
(45) Date of Patent: Feb. 23, 2016

(54) SUPPORT CASING FOR A COSMETIC ARTICLE AND ASSOCIATED PRODUCTION METHOD

(75) Inventors: Mathilde Gatesoupe, Ploemeur (FR); Patrice Barre, Antony (FR); Marc Lechanoine, Issy-les-Moulineaux (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 12/837,263

(22) Filed: Jul. 15, 2010

(65) Prior Publication Data

US 2011/0011418 A1 Jan. 20, 2011

Related U.S. Application Data

(60) Provisional application No. 61/228,760, filed on Jul. 27, 2009.

(30) Foreign Application Priority Data

Jul. 16, 2009 (FR) ..... 09 54932

(51) Int. Cl.
*A45D 40/22* (2006.01)
*A45D 33/00* (2006.01)
*A45D 33/22* (2006.01)

(52) U.S. Cl.
CPC ..... *A45D 33/006* (2013.01); *A45D 33/22* (2013.01); *A45D 40/22* (2013.01); *A45D 33/008* (2013.01); *Y10T 29/49826* (2015.01)

(58) Field of Classification Search
USPC ..... 132/293–307; 220/810, 831–832
See application file for complete search history.

(56) References Cited

U.S. PATENT DOCUMENTS

| | | | | | |
|---|---|---|---|---|---|
| 1,456,363 | A | | 5/1923 | Crippen | |
| 1,460,906 | A | | 7/1923 | Hyde | |
| 1,480,496 | A | | 1/1924 | Bobo | |
| 1,547,587 | A | * | 7/1925 | Kendall | 132/305 |
| 1,570,382 | A | * | 1/1926 | Lyhne | 132/296 |
| 1,612,409 | A | * | 12/1926 | Anderson | 132/295 |
| 1,618,598 | A | * | 2/1927 | Lyhne | 132/296 |
| 1,647,004 | A | | 10/1927 | Hyde | |
| 1,761,615 | A | * | 6/1930 | Coryell | 132/296 |

(Continued)

FOREIGN PATENT DOCUMENTS

| | | |
|---|---|---|
| DE | 2317085 | 10/1974 |
| DE | 3643638 | 6/1988 |

(Continued)

*Primary Examiner* — Rachel Steitz
*Assistant Examiner* — Jennifer Gill
(74) *Attorney, Agent, or Firm* — Novak Druce Connolly Bove + Quigg LLP

(57) ABSTRACT

A casing is provided that comprises a base (30), a lid (32) which is movable between a closure configuration. The base (30) and the lid (32) delimit an internal volume for receiving a cosmetic article and a configuration for access to the receiving volume. It comprises an insert (36) arranged in the receiving volume, the insert (36) being movable relative to the base (30) and relative to the lid (32) towards an intermediate position which is disengaged from the base (30) and disengaged from the lid (32) in the access configuration. The casing (10) comprises a releasable retainer (40) for retaining the insert (36) by friction in a position engaged on the lid (32), the lid (32) being capable of moving the insert (36) by means of the friction type retainer (40) over at least a portion of the travel of the lid (32) between the closure and access configurations.

16 Claims, 6 Drawing Sheets

(56) References Cited

U.S. PATENT DOCUMENTS

| | | | | | |
|---|---|---|---|---|---|
| 2,438,841 | A | | 3/1948 | Casalino | |
| 3,552,595 | A | | 1/1971 | Gerner et al. | |
| 3,786,982 | A | * | 1/1974 | Rakes et al. | 229/406 |
| 3,961,708 | A | | 6/1976 | von Dohlen et al. | |
| 4,421,127 | A | * | 12/1983 | Geer | 132/294 |
| 4,666,037 | A | | 5/1987 | Weissman | |
| 5,638,957 | A | * | 6/1997 | Brasier | 206/581 |
| 5,950,639 | A | * | 9/1999 | Suzuki et al. | 132/294 |
| 7,051,905 | B2 | * | 5/2006 | Hierzer | 222/546 |
| RE39,311 | E | * | 10/2006 | Davis et al. | 132/295 |
| 2009/0250360 | A1 | * | 10/2009 | Bellamah et al. | 206/247 |
| 2010/0285520 | A1 | * | 11/2010 | Halverson et al. | 435/30 |

FOREIGN PATENT DOCUMENTS

| | | | | |
|---|---|---|---|---|
| FR | 2872490 | | | 1/2006 |
| GB | 2168326 | A | * | 12/1984 |
| WO | WO 2008/013586 | | | 1/2008 |
| WO | WO 2008/050926 | | | 5/2008 |

* cited by examiner

SUPPORT CASING FOR A COSMETIC ARTICLE AND ASSOCIATED PRODUCTION METHOD

CROSS-REFERENCE TO RELATED APPLICATION

This application claims priority under 35 U.S.C. §119(e) that claims the benefit of U.S. Provisional Application No. 61/228,760, filed Jul. 27, 2009, and claims priority under 35 U.S.C. §119 from French Application No. 09 54932, filed Jul. 16, 2009, the entire contents of each of which are herein incorporated by reference.

FIELD OF THE INVENTION

The present invention relates to a support casing for a cosmetic article of the type comprising:

a base;

a lid which is mounted so as to be movable relative to the base between a closure configuration, in which the base and the lid delimit an internal volume for receiving the cosmetic article, and a configuration for access to the receiving volume;

an insert which is arranged in the receiving volume, the insert being mounted so as to be movable relative to the base and relative to the lid towards an intermediate position which is disengaged from the base and disengaged from the lid in the access configuration.

BACKGROUND OF THE INVENTION

Discussion of Background

The term "cosmetic article" is intended to refer according to the present invention in particular to a cosmetic product which is intended to be applied to a human being, as a solid such as a powder, a liquid or a cream.

That product is advantageously a self-supporting product having inherent mechanical strength, such as a slab or block of cosmetic product.

A "cosmetic product" is more generally a product as advantageously defined in the Council Directive 93/35 EC of 14$^{th}$ June 1993.

The term "cosmetic article" is also intended to refer to a tool being used directly or indirectly to apply the cosmetic product, such as an applicator of the type of a brush, small brush or pad, a flocked member, a sponge or a tool such as a mirror or a nail file.

The casing of the above-mentioned type is intended to contain in particular a slab of cosmetic product and an applicator in an internal volume defined by the base and the lid.

During storage of the casing, for example, in a handbag of a user, the lid is kept closed in order to prevent the product and the applicator from falling out of the casing and becoming spilled in the bag.

When the user wishes to carry out the application of product, she moves the lid from the closure configuration to a configuration for access to the internal volume. She grips the applicator in order to remove some product from the product slab and to arrange it on her skin or keratin fibres.

Casings of the above-mentioned type are known, for example, from U.S. Pat. Nos. 1,460,906, 1,456,363, 1,480,496, WO 2008/050926 and FR25881849.

In those casings, a cosmetic article is arranged on the insert or alternatively under the insert in a housing provided for the purpose in the base.

In the latter case, during production of the casing, the charging of the cosmetic article in the casing first requires that the lid be pivoted into its access configuration. Subsequently, the insert must be lifted relative to the base in order to arrange the cosmetic article in the housing provided in the base.

That additional step of lifting the insert increases the cycle time necessary for producing a casing and therefore reduces the productivity of the method for producing the casings, particularly when the casings are constructed in large numbers.

Furthermore, that lifting step has to be carried out using a specific tool which may be troublesome. The lifting of the insert must further be carried out reliably on each casing passing on the production line in order to prevent incorrect arrangement of the cosmetic article in a casing from bringing about stoppages of the line.

In any case, once the cosmetic article has been charged under the insert, the insert must remain maneuverable without excessive force by a user in order to allow it to become disengaged from the base in order to gain access to the cosmetic article.

SUMMARY OF THE INVENTION

Therefore, an object of the invention is to obtain a casing which is for supporting a cosmetic article and which comprises an insert interposed between a base and a lid, that casing being able to be produced more cheaply and easily, in particular when a cosmetic article must be inserted under the insert in a housing provided in the base.

Another object of the invention is to allow cosmetic product to be charged in a casing comprising an insert by means of a production line having simple and reliable tooling, with minimal risks of stoppages of the line during large-batch production.

Another object of the invention is to provide a casing which can readily be provided with a cosmetic article during its production whilst remaining simple to use by the end user thereof.

To that end, the invention relates to a casing of the above-mentioned type, characterised in that the casing comprises releasable means for retaining the insert by friction in a position engaged on the lid, the lid being capable of moving the insert by means of the friction type retention means over at least a portion of the travel of the lid between the closure configuration and the access configuration.

The casing according to the invention may comprise one or more of the following features taken in isolation or in accordance with any technically possible combination:

the friction type retention means comprise a retention surface located on the insert and a complementary retention surface located on the lid, the retention surface and the complementary retention surface being in circumferential contact relative to a local axis of movement of the insert towards the position thereof disengaged from the lid when the insert occupies the position thereof engaged on the lid;

the means for retaining the insert by friction on the lid can be released by a separation force being applied between the insert and the lid of less than 15 Newton and advantageously of greater than 0.5 Newton;

the friction type retention means comprise a retention projection which is fixedly joined to one of the lid or the insert, the retention projection being applied to the other of the lid or the insert when the insert occupies its position engaged on the lid;

the projection has a ground retention surface;

the retention projection is applied to a complementary retention surface of the lid or the insert, the complementary retention surface not being provided with a relief opposite the retention projection;

the casing comprises at least two retention projections which are angularly spaced apart by at least 60°, advantageously by at least 90°, about an axis of the insert in the position engaged in the lid;

the insert is articulated relative to the lid between the position engaged on the lid and the position disengaged from the lid, the lid being advantageously articulated to the base between the closure configuration and the access configuration;

the lid is capable of moving the insert by means of the friction type retention means over the entire travel of the lid between the closure configuration and the access configuration;

the insert has a lens-like shape delimiting at least one through-hole opening opposite the base and opposite the lid;

the casing comprises a cosmetic article provided in the base, the cosmetic article protruding at least partially through the through-hole in the closure configuration;

the insert comprises a peripheral groove for receiving a cosmetic article, the peripheral groove being located around the through-hole;

the insert comprises a holding means which is capable of being held to move the insert from its position engaged on the lid, the holding means advantageously being a holding lug or a holding notch and the holding means is arranged on a surface of the insert located opposite the lid in the access configuration; and the insert delimits at least one abutment stop which is capable of cooperating with the base in order to prevent movement of the insert away from the base from an intermediate configuration of the lid between the access configuration and the closure configuration.

The invention also relates to a method for producing a casing containing a cosmetic article, characterised in that it comprises the following steps:

providing a casing as defined above, the lid occupying its closure configuration;

opening the lid by moving it towards the access configuration, the insert moving together with the lid over at least a portion of the travel of the lid between the closure configuration and the access configuration;

inserting a cosmetic article in the base by passing it between the insert and the base;

optionally closing the lid by moving it towards the closure configuration thereof.

The invention also relates to a support casing for a cosmetic article of the type comprising:

a base;

a lid which is mounted so as to be movable relative to the base between a closure configuration, in which the base and the lid delimit a volume for receiving the cosmetic article, and a configuration for access to the receiving volume;

an insert which is arranged in the receiving volume, the insert being mounted so as to be movable relative to the base and relative to the lid in order to occupy an intermediate position which is disengaged from the base and disengaged from the lid in the access configuration, characterized in that the insert has a lens-like shape delimiting at least one through-hole opening opposite the base and opposite the lid.

In that variant, the casing does not necessarily comprise releasable means for retaining the insert by friction in a position engaged on the lid.

It optionally comprises one or more of the features set out above, taken in isolation or in accordance with any technically possible combination.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

The invention will be better understood from a reading of the following description which is given purely by way of example with reference to the appended drawings, in which.

DETAILED DESCRIPTION OF THE PREFERRED EMBODIMENTS

Figure 1:
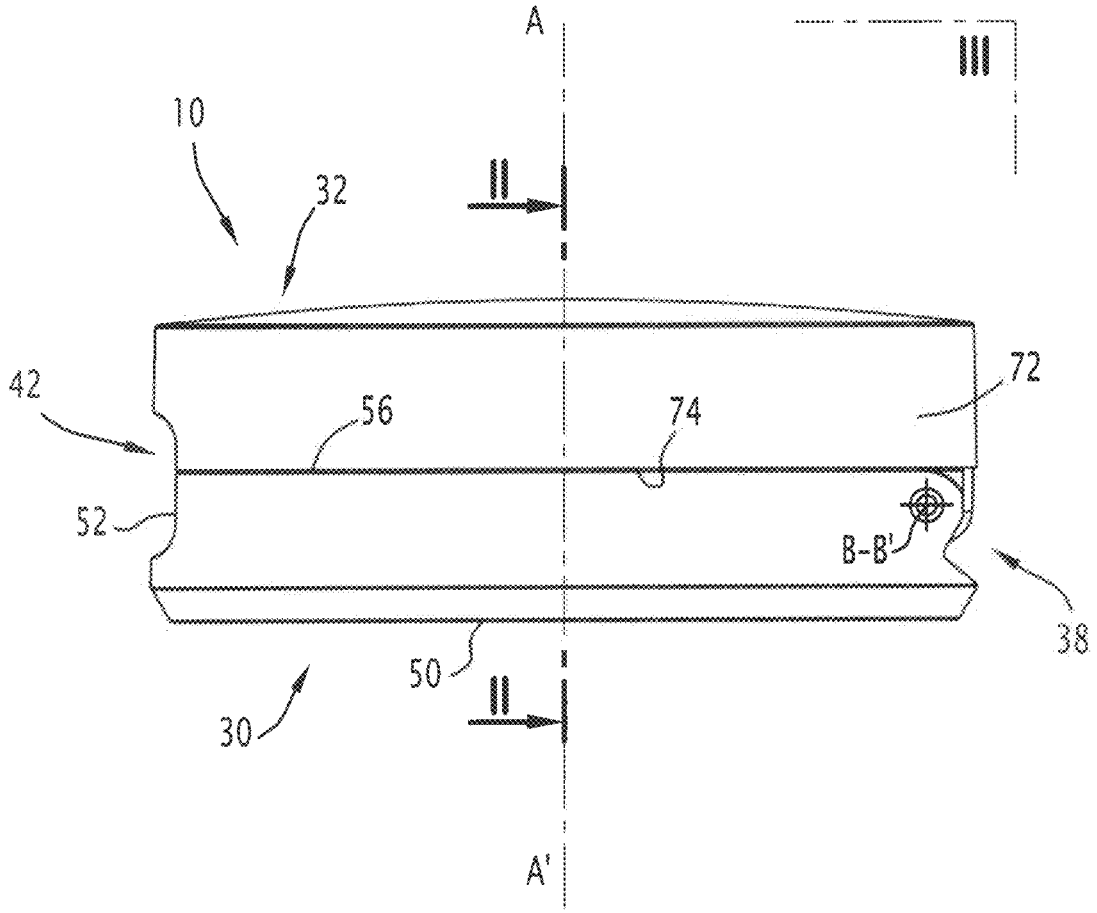
FIG. 1 is a side view of a first support casing according to the invention with a lid occupying a configuration for closing the internal volume.

Referring now to the drawings, like reference numerals are utilized to designate identical or corresponding parts throughout the several views.

Hereinafter, the orientations are intended to be understood in a relative manner in relation to the illustrations in the Figures.

The term "front" generally designates an element located nearer the user during use of the casing whilst the term "rear" generally designates an element more remote from the user during use of the casing.

A first support casing 10 for cosmetic articles 12, 14 is illustrated in FIGS. 1 to 8.

As will be seen below, the casing 10 is intended to contain at least one cosmetic article 12 which is formed, for example, by a cosmetic product intended to be applied to a human being, as a solid such as a powder, a liquid or a cream.

That product is advantageously a self-supporting product, having inherent mechanical strength, such as a slab of cosmetic product.

In the example illustrated in the Figures, a first cosmetic article 12 provided in the casing 10 is formed by a slab 16 of cosmetic product provided in the casing 10. That cosmetic product is advantageously a cast or compacted product, such as an eye-shadow, a lip product or a make-up product for the skin and/or keratin fibres of a user.

The cosmetic product slab 16 is carried by a cup 18 which is fixed in the casing 10. In this example, it has an upper surface 17 which is substantially of dome-like form.

A second cosmetic article 14 contained by the casing 10 may be a tool being used directly or indirectly for applying the cosmetic product, such as an applicator of the type of a brush, small brush or pad, a flocked member, a sponge or a tool such as a mirror or a nail file.

In the FIGS. 1 to 8, the casing 10 comprises a second cosmetic article 14 which is an applicator 20 of cosmetic product.

Figure 8:
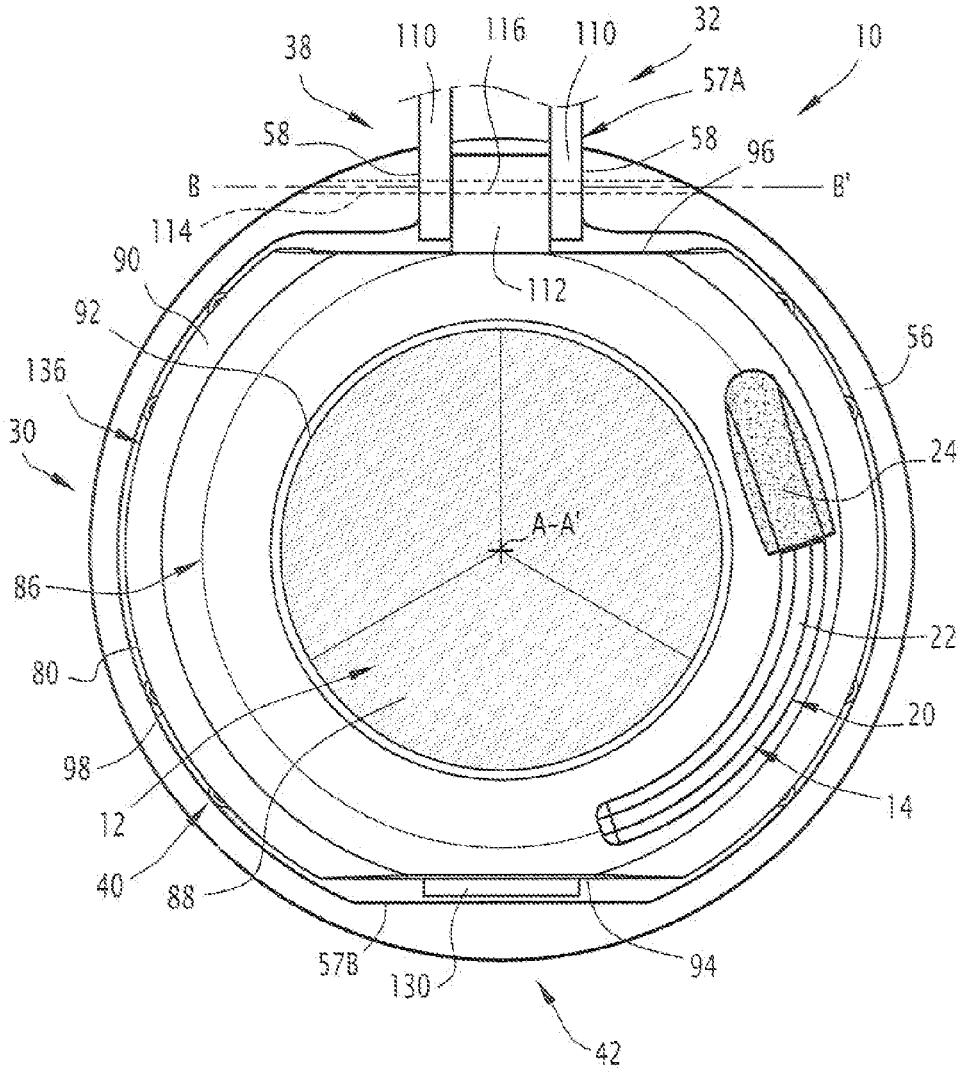
FIG. 8 is a top view of the casing illustrated in FIG. 6, the insert being arranged in a position for abutment against the base.

As illustrated in FIG. 8, the applicator 20 comprises a curved handle 22 which is substantially in the form of a circular arc and an application end-piece 24 which is intended to move into contact with the slab 16 of cosmetic product in order to allow the product to be applied to the skin or the keratin fibres of the user.

With reference to FIGS. 1 to 3 and 6 and 7, the casing 10 comprises a base 30 and a movable lid 32 which is formed by a cover, the base 30 and the lid 32 delimiting an internal volume 34 for receiving the cosmetic articles 12, 14.

The casing 10 further comprises an insert 36 which is provided in the internal volume 34 and which is mounted so as to be movable relative to the base 30 and relative to the lid 32, elements 38 for articulating the lid 32 and the insert 36 to the base 30 and, according to the invention, releasable means 40 for retaining the insert 36 by friction in a position engaged on the lid 32.

The casing 10 further comprises elements 42 for securing the lid 32 to the base 30.

The casing 10 has a generally revolution shape about a centre axis A-A' which is vertical in FIG. 1. The casing 10 thereby has a generally circular or oval cross-section.

In a variant, the casing 10 has a horizontal cross-section which is polygonal, for example, rectangular or square.

The base 30 comprises a bottom wall 50 which is intended to be put on a support and a side wall 52 which protrudes from the bottom wall 50 in order to delimit a lower housing 53.

The base 30 further comprises opposing support stops 54 for the insert 36, which are provided in the lower housing 53. In a variant, the base 30 comprises a single stop 54.

Figure 2:
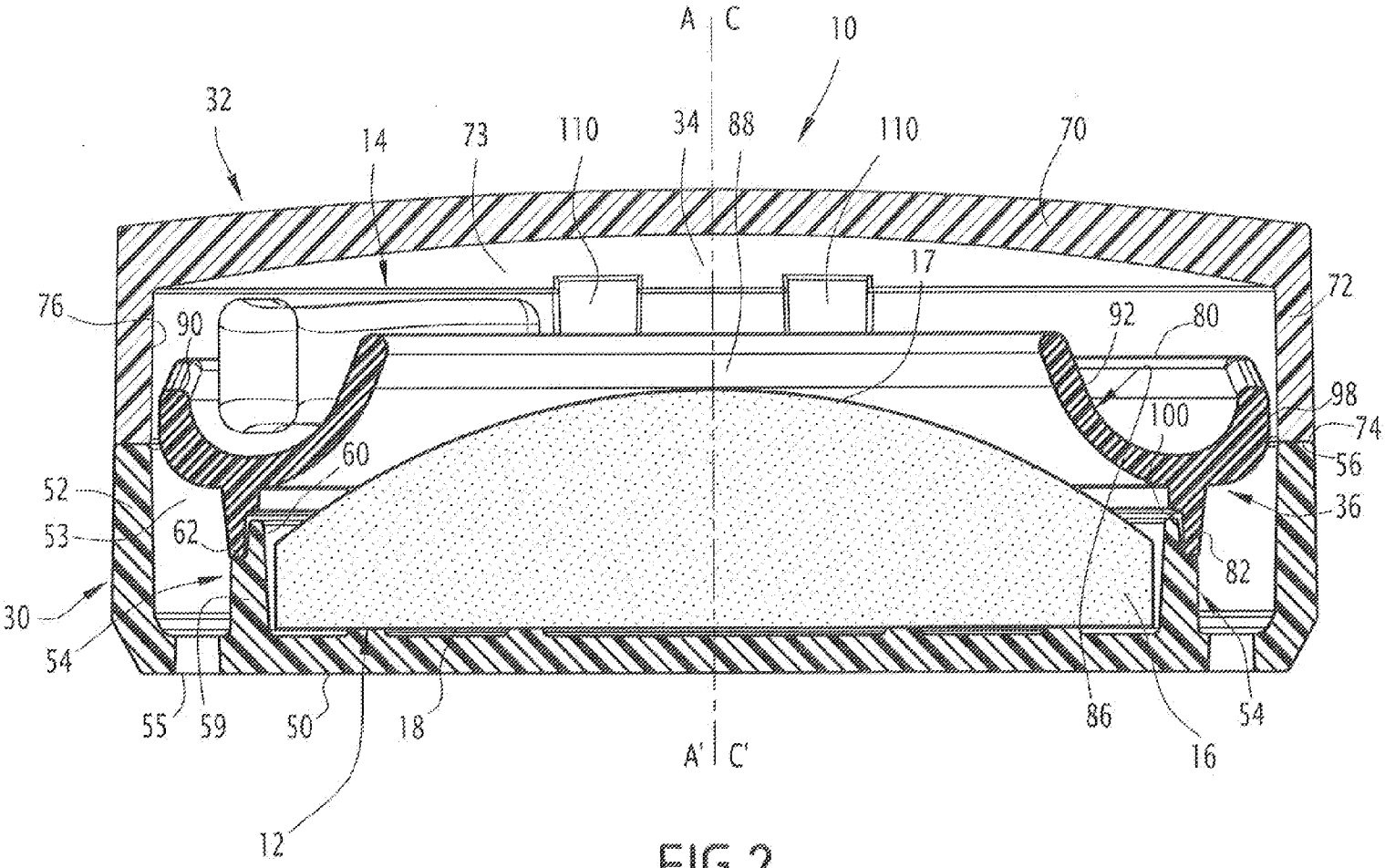
FIG. 2 is a sectional view taken in a vertical centre plane II of FIG. 1.
Figure 3:
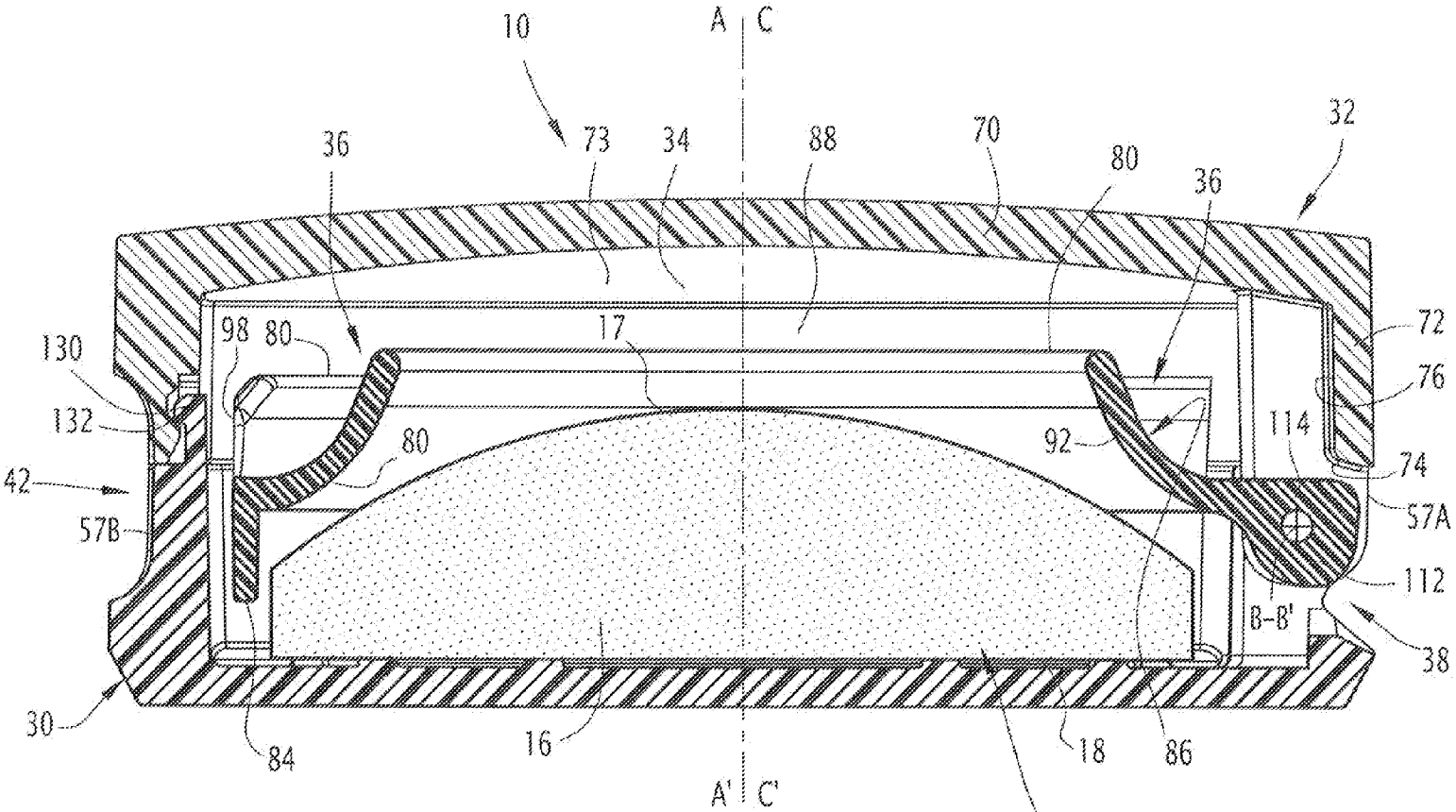
FIG. 3 is a sectional view taken in a vertical centre plane III perpendicular to the plane II.
Figure 4:
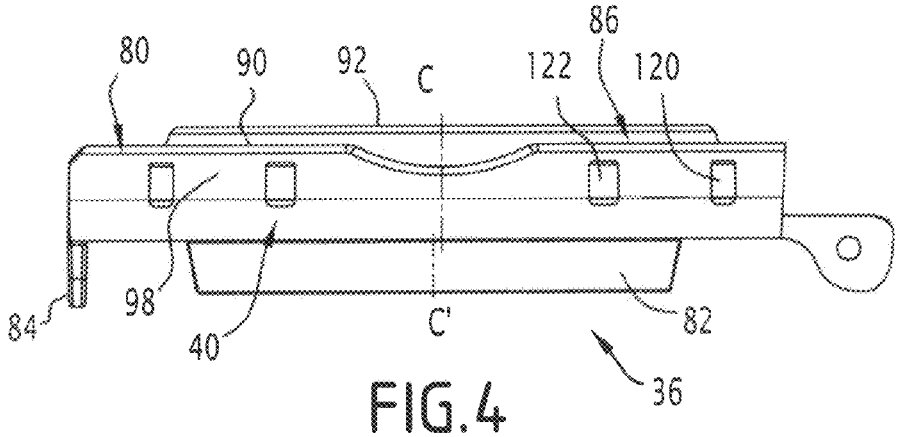
FIG. 4 is a side view of the insert arranged in the internal volume of the casing of FIG. 1.

The bottom wall 50 extends perpendicularly to the axis A-A', substantially horizontally in FIGS. 1 to 3. In this example, it has a substantially circular contour.

The side wall 52 protrudes towards the lid 32 from the peripheral edge of the bottom wall 50 as far as a free edge 56, which extends in a plane substantially perpendicular to the axis A-A'.

The bottom wall 50 delimits, in the region of the peripheral edge thereof, through-passages 55 for the flow of air allowing air to be introduced into the internal volume 34. The passages 55 are located radially outside the stops 54.

The product slab 16 is fixed to the bottom wall 50 between the stops 54 in the lower housing 53.

The height of the side wall 52, taken between the bottom wall 50 and the free edge 56, is slightly less, for example, less than 90% of the height of the product slab 16.

As illustrated in FIG. 8, the side wall 52 delimits a rear notch 57A for receiving the articulation elements 38 and a vertical front flat portion 57B for access to the securing elements 42.

The rear notch 57A is delimited laterally by two lateral edges 58 of the wall 52 which are visible in FIG. 8. The edges 58 each define a through-opening 58A which has an axis B-B' perpendicular to the axis A-A' and which is intended to receive a pivot pin of the lid 32. The through-openings 58A open in the notch 57A perpendicularly to the axis A-A'.

With reference to FIGS. 2 and 3, the stops 54 have a height which is less than the height of the side wall 52. In the example illustrated in the Figures, the base 30 comprises two stops 54 which are substantially of circular-arc-like form.

Each stop 54 has a lower portion 59 which protrudes towards the lid 32 from the bottom wall 50 and an upper portion 60 which delimits with the lower portion 59 an external abutment shoulder 62 for the insert 36.

In this example, the base 30 is constructed in one piece, the walls 50, 52 and the stops 54 being integral.

The lid 32 comprises an upper closure wall 70 and a peripheral wall 72 which protrudes towards the base 30 from the upper wall 70. The walls 70, 72 delimit an upper space 73 for receiving the insert 36.

The upper wall 70 is of a shape slightly curved away from the base 30. It has an external contour edge which is substantially similar to the contour of the bottom wall 50.

The peripheral wall 72 protrudes downwards from the outer edge of the wall 70 as far as a free edge 74 which is intended to be applied to the free edge 56 of the side wall 52.

The peripheral wall 72 delimits a substantially cylindrical internal surface 76 which extends around the axis A-A'. The internal surface 76 is substantially smooth opposite the friction type retention means 40, as will be seen in detail below.

Figure 6:
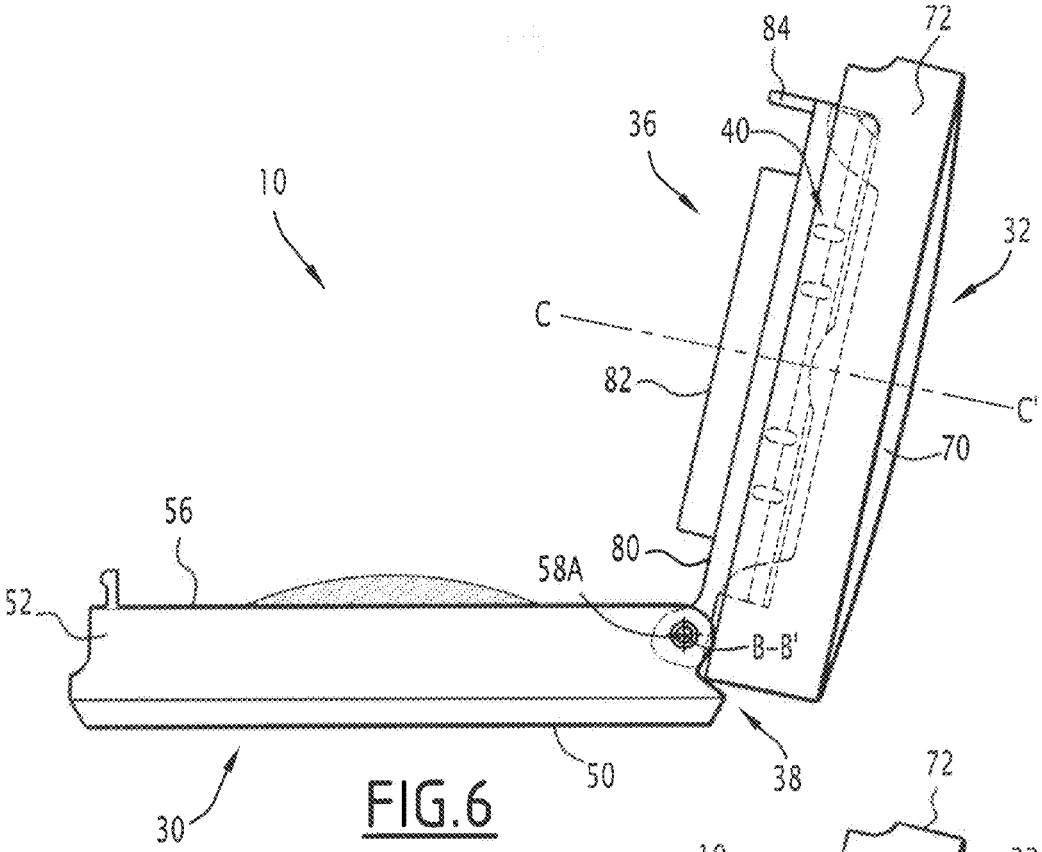
FIG. 6 is a view similar to FIG. 1, in a configuration for access to the internal volume of the casing, the insert occupying a position engaged on the lid.

The movable lid 32 is movable relative to the base 30 between a closure configuration, illustrated in FIG. 1, in which the lid 32 and the base 30 delimit and close the internal volume 34 and a configuration for access to the internal volume 34, illustrated in FIG. 6.

In the closure configuration, the lid 32 is applied to the base 30. The internal volume 34 is formed by the lower housing 53 and the upper space 73. It is delimited in the downward direction by the bottom wall 50 and the side wall 52, and in the upward direction by the peripheral wall 72 and the upper wall 70.

The free edge 74 of the peripheral wall 72 is applied to the free edge 56 of the side wall 52. The upper wall 70 extends vertically opposite the bottom wall 50, substantially perpendicularly to the axis A-A'. The lid 32 and the base 30 prevent access to the cosmetic articles 12, 14 contained in the internal volume 34.

In the access configuration, the lid 32 has been pivoted about the axis B-B' relative to the casing 10 through an angle greater than 90° and in particular substantially of 120°.

The free edge 74 of the peripheral wall 72 is arranged in abutment against the side wall 52, for example, on the bottom of the notch 57A. The internal volume 34 is open in order to afford the user access to the cosmetic articles 12, 14 contained in the casing 10. In this manner, the upper wall 70 and the free edge 74 extend substantially to the rear of the space located vertically above the bottom wall 50.

In this example, the lid 32 is constructed in one piece, the walls 70, 72 being integral.

The insert 36 comprises a hollow body 80 for receiving the cosmetic article 14, having an axis C-C', abutment stops 82 which are intended to cooperate with the support stops 54 and a member 84 for holding the insert in order to move it away from the lid 32.

In the example illustrated in FIGS. 1 to 8, the hollow body 80 is of generally lens-like shape. In this manner, it comprises a peripheral groove 86 for receiving the cosmetic article 14 which delimits a central through-hole 88 for access to the cosmetic product 16.

The peripheral groove 86 extends around the axis C-C'. It is delimited externally by two external wall portions 90 and internally by an internal wall 92 which defines the through-hole 88.

Each external portion 90 extends between a front edge 94 of the body 80 and a rear edge 96 of the body 80. The front edge 94 and the rear edge 96 extend parallel with each other in a vertical plane parallel with the axis C-C' and parallel with the axis B-B'.

When the insert 36 rests on the base 30, the front edge 94 is positioned opposite the securing elements 42 whilst the rear edge 96 is positioned opposite the rear notch 57A.

The external portions 90 have a curved shape centred on the axis C-C'. They each define a substantially cylindrical external surface 98 which is intended to be positioned opposite and remote from the internal surface 76 of the lid 32.

In a section taken in a vertical plane extending along the axis C-C', the internal wall 92 has a shape which converges towards the axis C-C' in the direction towards the lid 32 around the through-hole 88. The internal wall 92 has a height greater than the height of each external wall portion 90.

The through-hole 88 is thus defined by the internal wall 92. It extends through the insert 36 and opens in an upward direction opposite the lid 32 and in a downward direction opposite the base 30.

The minimum cross-section of the through-hole 88, taken perpendicularly to the axis A-A', is greater than 30% of the maximum cross-section of the insert 36 taken perpendicularly to the axis A-A'.

The minimum cross-section of the through-hole 88 taken perpendicularly to the axis A-A' is greater than 40% of the maximum cross-section of the product slab 16 taken perpendicularly to the axis A-A'.

The abutment stops 82 protrude towards the base 30 from the bottom of the groove 86. They have a shape which substantially corresponds to the shapes of the support stops 54.

In this manner, each abutment stop 82 defines an internal shoulder 100 having a shape complementary to the external shoulder 62 defined by the support stops 54.

When the abutment stops 82 cooperate with the support stops 54, the internal shoulder 100 is arranged in abutment against the external shoulder 62.

In that configuration, the insert 36 is fixed in position in a downward direction relative to the base 30. It generally extends in a plane substantially parallel with the plane of the bottom wall 50. Its axis C-C' is parallel or aligned with the axis A-A'.

The holding member 84 extends in the region of the front edge 94. In that example, the member 84 is formed by a lug which protrudes towards the base 30, parallel with the axis C-C'.

Figure 7:
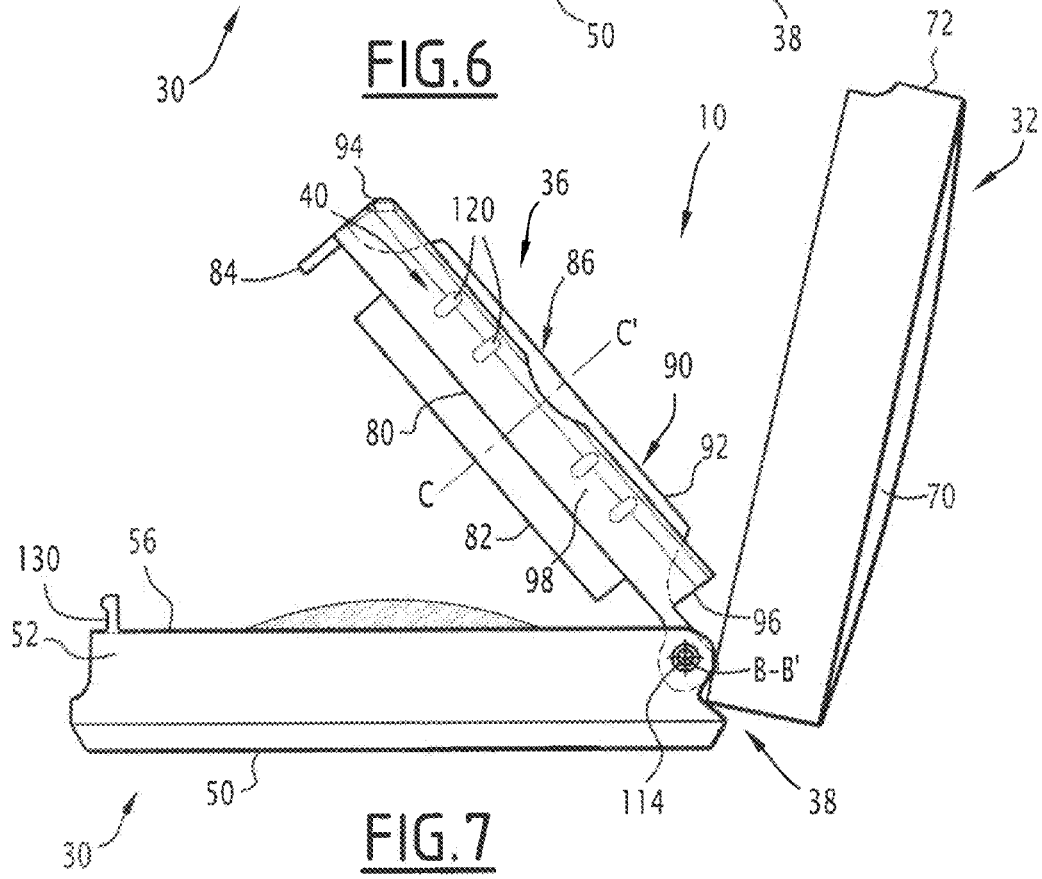
FIG. 7 is a view similar to FIG. 6, the insert having been moved into an intermediate position disengaged from the lid.

The insert 36 is mounted so as to be movable relative to the base 30 and relative to the lid 32 between an upper position engaged on the lid 32, illustrated in FIG. 6, an intermediate position disengaged from the lid 32 and disengaged from the base 30, illustrated in FIG. 7, and a lower position arranged in abutment in the base 30 illustrated in FIG. 8.

In the upper position, the insert 36 is partially inserted in the space 73 delimited by the lid 32. The groove 86 and the wall portions 90 are positioned opposite the internal surface 76 of the peripheral wall 72.

In that position and as will be seen below, the friction type retention means 40 are active and allow common movement of the lid 32 and the insert 36 over at least a portion of the travel of the lid 32 between the closure configuration and the access configuration thereof.

In the intermediate position illustrated in FIG. 7, the friction type retention means 40 have been released.

The insert 36 has been withdrawn out of the lower housing 53 and out of the upper space 73.

The groove 86 and the wall portions 90 are arranged completely remote from the base 30 and the insert 36.

In the lower position illustrated in FIG. 8, the abutment stops 82 are arranged in abutment against the support stops 54. The insert 36 extends substantially parallel with the bottom wall 50 and is inserted partially in the lower housing 53. The insert 36 partially closes the lower housing 53 of the base 30 in an upward direction. The external portions 90 protrude at least partially beyond the free edge 56.

The cosmetic product slab 16 protrudes partially into the transverse hole 88 which allows the thickness of the casing 10 to be reduced.

In that example, the insert 36 is constructed in one piece, the body 80, the stops 82 and the holding member 84 being integral.

With reference to FIG. 8, the articulation assembly 38 comprises articulation arms 110 which are fixedly joined to the lid 32, an articulation tongue 112 which is fixedly joined to the insert 36 and a pivot pin 114 which is inserted through the lateral edges 58 of the notch 57A, through the arms 110 and through the tongue 112 along the axis B-B'.

The arms 110 protrude towards the base 30 from the side wall 72. Each arm 110 defines an internal passage having an axis B-B' for the insertion of the pin 114. The arms 110 are integral with the lid 32.

Each arm 110 is applied against a lateral edge 58 of the notch 57A. The arms 110 together delimit a space 116 which is for insertion of the tongue 112 and which has a shape complementary to the tongue 112.

The tongue 112 protrudes backwards from the rear edge 96 of the body 80. It is integral with the body 80. It internally defines a passage for insertion of the pin 114. It is inserted between the two arms 110.

In this manner, the lid 32 is rotationally movable in relation to the base 30 about the axis B-B' defined by the pin 114 by means of the articulation arms 110 which pivot about the axis 116 between the closure configuration and the configuration for access to the internal volume 34.

Similarly, the insert 36 is rotationally movable about the axis B-B' in relation to the base 30 and the lid 32 by means of the tongue 116 which pivots about the axis 114, between the lower position, the intermediate position and the upper position.

According to the invention, the friction type retention means 40 comprise a plurality of projections 120 which are fixedly joined to the insert 36, the projections 120 cooperating by friction with the smooth internal surface 76 defined by the lid 32.

In that example, the projections 120 are formed by ribs which are substantially in the form of grains of rice. They are elongate in an axis parallel with the axis C-C' defined by the insert 36.

Figure 5:
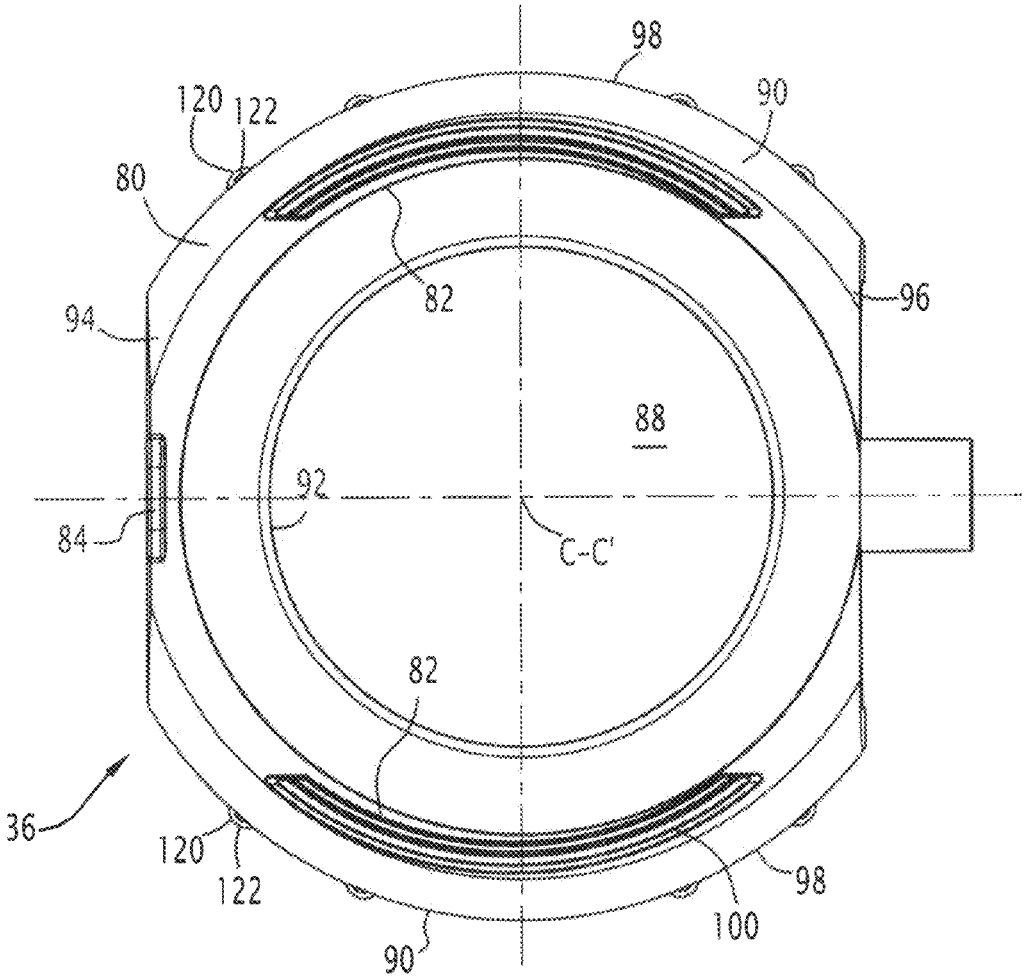
FIG. 5 is a bottom view of the insert illustrated in FIG. 4.

In that example, and as illustrated in FIG. 5, the means 40 comprise eight projections 120 which are distributed angularly about the axis C-C'.

More generally, the number of projections 120 is between 1 and 10, preferably between 1 and 8.

Advantageously, the friction type retention means comprise at least two projections 120 which are angularly spaced apart by more than 60°, advantageously by more than 90°, for example, substantially 120°, about the axis C-C'.

Each projection 120 protrudes radially relative to the axis C-C' from the external surface 98.

In that example, each projection 120 extends angularly over an angle greater than 1° and less than 30° about the axis C-C'.

The radial thickness of the projection 120, taken between the external surface 98 and a retention surface 122 on the internal surface 76 is slightly greater than the distance separating the external surface 98 from the internal surface 76 at rest opposite the projection 120.

The retention surface 122 is advantageously ground in order to increase the friction coefficient between the insert 36 and the lid 32.

That grinding is obtained, for example, by selective abrasion or by not polishing the wall of the mould that is intended to form the insert 36 opposite the surface 122.

When the insert 36 occupies its upper position engaged in the lid 32, the retention surface 122 of the projection 120 is in contact with the internal surface 76 in at least one contact region.

The surfaces 76, 122 are in exclusively circumferential contact relative to a local movement axis of the insert 36 towards the position thereof disengaged from the lid 32 when the insert 36 occupies its position engaged on the lid 32.

In this manner, no transverse surface relative to the local movement axis of the insert 36 acts counter to the movement of the insert 36 away from the lid 32.

The friction between the surfaces 122, 76 brings about a force for retaining the insert 36 on the lid 32 having an axis parallel with the axis C-C' which thus extends parallel with the contact region between the surfaces 122, 76.

That force is greater than 0.5 Newton and is less than 15 Newton in order to simultaneously allow adequate retention of the insert 36 relative to the lid 32 in the position engaged on the lid 32, whilst it remains possible for the user to move, without too much effort, the insert 36 away from the lid 32, in order to access the space above the insert 36.

The means 40 for retaining the insert 36 on the lid 32 by friction can thereby be released by a separation force being applied between the insert 36 and the lid 32 that is greater than 0.5 Newton and advantageously less than 15 Newton parallel with the axis C-C'.

The complementary retention surface formed by the internal surface 76 is not provided with a relief opposite each projection 120. The term "not provided with a relief" is intended to mean that the surface 76 does not have recesses or protrusions over an angular extent greater than at least 10%, advantageously greater than at least 30% of the angular extent of the projection 120. That facilitates the production of the lid 32.

In the lower position in abutment in the base 30, the projections 120 protrude at least partially above the free edge 56 of the side wall 52 in order to be able to cooperate with the internal surface 76 when the lid 32 is closed towards the closure configuration thereof.

The friction type retention means 40 are separate from the articulation elements 38 and the securing elements 42.

The securing elements 42 comprise a snap-fit lug 130 which is fixedly joined to the base 30 and a groove 132 for blocking the snap-fit lug 130 that is provided in the lid 32. In a variant, the groove 132 is provided in the base 30 and the lug 130 is fixedly joined to the lid 32.

The lug 130 protrudes towards the lid 32 above the free edge 56 from a front region of the side wall 52. It can be moved by deformation towards the axis A-A' between a rest position located further away from the axis A-A' and a release position nearer the axis A-A'. It has a snap-fit head which protrudes radially away from the axis A-A'.

The groove 132 is provided in the side wall 72 in a front region of the lid 32. It opens in the internal surface 76 towards the axis A-A'.

In the closure configuration of the lid 23, the lug 130 is inserted in the groove 132 and occupies its rest position, which ensures that the lid 32 is fixed in position relative to the base 30.

In order to move the lid 32 into its configuration for access to the internal volume 34, the lug 130 is deformed radially towards the axis A-A' in order to remove it from the groove 132.

The production and operation of the first casing 10 according to the invention will now be described.

Initially, the base 30, the lid 32 and the insert 36 are constructed, for example, by moulding a plastics or metal material. The articulation elements 38 are assembled to articulate the lid 32 and the insert 36 to the base 30 about the axis B-B'.

The lid 32 is positioned in its configuration for access to the internal volume and the insert 36 is positioned in its lower position, with the abutment stops 82 thereof placed in abutment against the blocking stops 54 of the base 30.

The insert 36 partially closes the lower housing 53 in an upward direction.

The cosmetic article 14 is then arranged in the insert 36. To that end, in the example illustrated in FIG. 8, the applicator 20 which has a suitable curvilinear shape is arranged in the peripheral groove 86 between the internal wall 92 and an external wall portion 90.

Subsequently, the lid 32 is closed in order to move into its closure configuration.

During that movement of the lid 32, the retention surface 122 of each projection 120 progressively moves into the upper space 73 defined below the lid 32 and cooperates by friction with the complementary internal retention surface 76 which is delimited by the lid 32, which activates the friction type retention means 40.

Since the surface 76 is smooth opposite each projection 120, the lid 32 is closed without sticking and in a simple manner without it being necessary to snap-fit or screw an element.

Since the insert 36 is fixed in position vertically downwards relative to the base 30 by means of cooperation between the stops 54 and 82, it remains substantially fixed in position during movement of the lid 32 downwards.

The snap-fit lug 130 is then inserted into the groove 132 which fixes the lid 32 in position.

When the lid 32 occupies its closure configuration, the casing 10 is moved to a station for charging the cosmetic article 12 in the base 30.

At that station, the lid 32 is moved from its closure configuration illustrated in FIG. 1 to its configuration for access to the internal volume illustrated in FIG. 6, by releasing the securing elements 42 then by pivoting the lid 32 about the axis B-B' relative to the base 30, whilst being guided by the articulation elements 38.

During that movement, the friction type retention means 40 retain the insert 36 in its upper position engaged in the lid 32 by friction between the retention surface 122 located on each projection 120 and the internal surface 76 opposite.

The insert 36 moves away from the base 30 and pivots about the axis B-B' together with the lid 32, which allows access in an upward direction to the lower housing 53 delimited in the base 30.

The cosmetic article 12 which is formed in this example by a cosmetic product slab 16 carried by a cup 18 is inserted in the lower housing 53 of the base 30, passing between the lower surface of the insert 36 and the base 30. It is arranged between the stops 54 and is then fixed to the bottom wall 50, for example, by adhesion, force-fitting or snap-fitting.

In this manner, during charging of the cosmetic article 12 in the base 30, it is not necessary to provide a specific tool for moving the insert 36 relative to the base 30, but only a tool which allows the lid 32 to be moved from its closure configuration to its access configuration.

Therefore, the method for producing the casing 10 containing the cosmetic articles 12, 14 is simplified.

When the user wishes to use the casing 10 to apply some cosmetic product 16 to her skin or to her keratin fibres, first she releases the securing elements 42 by moving the lug 130 away from the groove 132.

The user then pivots the lid 32 from its closure configuration to its access configuration by pivoting it about the axis B-B' by means of the articulation elements 38. That movement moves the insert 16 away from the base 30 about the axis B-B', as described above.

If it has an external applicator with respect to the casing 10, the user can use that applicator to remove some product 16 from the base 30.

Alternatively, the user holds the handling member 84 which projects away from the lid 32. Subsequently, the user pivots the insert 36 away from the lid 32 towards the base 30, overcoming the friction type retention force provided by the releasable retention means 40.

Since the friction type retention force is brought about only by cooperation between non-transverse surfaces 122, 76 relative to the force applied, the release of the insert 36 relative to the lid 32 is brought about by a simple action to carry out and requires reasonable force. In particular, it is not necessary to move a snap-fit element or to unscrew a screwing member to release the insert 36. In this manner, the insert 36 is retained in the lid 32 only by friction.

Subsequently, the user moves the insert 36 into its lower position in contact with the base 30. The user holds the handle 22 of the applicator provided in the groove 86 and removes some product 16 by means of the end piece 24 by passing the end piece 24 through the through-hole 88.

In the first casing 10 according to the invention, the insert 36 is movable together with the lid 32 over the entire travel of the lid 32 between the closure configuration and the access configuration.

In a variant, the casing 10 comprises a stop for fixing the insert 36 in an intermediate position along the movement path of the lid 32 relative to the base 30, for example, in the position illustrated in FIG. 7.

In another variant (not illustrated), the lid 32 can be moved relative to the insert 36 by means of another movement such as, for example, a combination of a rotation and translation movement about an axis A-A'. This particularly applies when the lid 32 is screwed to the base 30. In that case, the friction type retention means 40 keep the insert 36 engaged on the lid 32 at least over a portion of the travel of the lid 32 relative to the base 30, as described above.

In another variant, the projections 120 are fixedly joined to the lid 32. They protrude radially towards the axis A-A' and are intended to be applied to the complementary retention surface formed by the external surface 98 of the insert 36.

In another variant, the angular extent of each projection 120 is greater than 30°.

More generally, the friction type retention means 40 may comprise a single retention surface 122 which is located on the insert 36 or on the lid 32 and which extends over substantially the whole of the periphery of the insert or the lid, respectively, about the axis C-C'. The retention surface 122 cooperates by friction with a complementary retention surface on the lid 32 or the insert 36 over the whole periphery of the lid or insert 36, respectively.

In one variant, the insert 36 is not provided with a through-hole 88. It forms a solid cup which is intended to receive a cosmetic article 14 and which completely closes the lower housing 53 defined by the base 30.

In the context of the present application, the term "a/an" is intended to be understood as "at least a/an", unless otherwise indicated.

Obviously, numerous modifications and variations of the present invention are possible in light of the above teachings. It is therefore to be understood that within the scope of the appended claims, the invention may be practiced otherwise than as specifically described therein.

The invention claimed is:

1. A Support casing for a cosmetic article of the type comprising:

a base containing a cosmetic article formed by a cosmetic product;

a lid which is mounted so as to be movable relative to the base between a closure configuration, in which the base and the lid delimit an internal volume for receiving the cosmetic article, and a configuration for access to the receiving volume;

an insert which is arranged in the receiving volume, the insert being mounted and configured to be movable relative to the base and relative to the lid towards an intermediate position which is disengaged from the base and disengaged from the lid in the access configuration, the insert having an external wall portion;

wherein the insert is configured to be moved towards a lower position m which it is inserted partially in a lower housing delimited by the base, in abutment against the base, and in which the external wall portion of the insert protrudes out of the lower housing beyond a free edge of the base;

the insert being articulated relative to the lid between a position engaged on the lid and a position disengaged from the lid, wherein the casing includes a releasable retainer to retain the insert by fiction in a position engaged on the lid, the lid, being capable of moving the insert by the friction type retainer over at least a portion of the travel of the lid between the closure configuration and the access configuration, and wherein the retainer comprises retention elements located on said external wall portion, the retention elements being configured to be located beyond the free edge of the base out of the lower housing in the lower position of the insert in order to cooperate with the lid in the lower position of the insert and in the closure configuration of the lid; and wherein the retainer to retain the insert by friction on the lid can be released by a separation force being applied between the insert and the lid greater than 0.5 Newton and less than 15 Newton.

2. Casing according to claim 1, wherein that the friction type retainer comprise a retention surface located on the insert and a complementary retention surface located on the lid, and wherein the retention surface and the complementary retention surface being in circumferential contact relative to a local axis of movement of the insert towards the position of the insert that is disengaged from the lid from the position of the insert when it occupies the position thereof engaged on the lid.

3. The casing according to claim 1, wherein that the friction type retainer comprise a retention projection which is fixedly joined to one of the lid or the insert, the retention projection being applied to the other of the lid or the insert when the insert occupies its position engaged on the lid.

4. The casing according to claim 3, wherein the projection has a ground retention surface.

5. The casing according to claim 3, wherein the retention projection is applied to a complementary retention surface of the other of the lid or the insert, the complementary retention surface not being provided with a relief opposite the retention projection.

6. The casing according to claim 3, wherein it comprises at least two retention projections which are angularly spaced apart by at least 60°, advantageously by at least 90°, about an axis of the insert in the position engaged in the lid.

7. The casing according to claim 1, wherein the lid is capable of moving the insert by means of the friction type retainer over the entire travel of the lid between the closure configuration and the access configuration.

8. The casing according to claim 1, wherein the insert is configured for delimiting at least one through-hole opening opposite the base and opposite the lid.

9. The casing according to claim 8, wherein the cosmetic article protrudes at least partially through the through-hole in the closure configuration.

10. The casing according to claim 8, wherein the insert comprises a peripheral groove for receiving a second cosmetic article, the peripheral groove being located around the through-hole.

11. The casing according to claim 1, wherein the insert comprises a holder which is capable of being held by a user to move the insert from its position engaged on the lid, the holder advantageously being a holding lug or a holding notch and in that the holder is arranged on a surface of the insert located opposite the lid in the access configuration.

12. The casing according to claim 1, wherein the base comprises at least one fixing stop which is configured to prevent movement of the insert away from the base from an intermediate configuration of the lid, which is a configuration between the access configuration and the closure configuration.

13. A method for producing a casing containing a cosmetic article, wherein that it comprises the following steps:

providing a casing according to claim 1, the lid occupying its closure configuration;

opening the lid by moving it towards the access configuration, the insert moving together with the lid over at least a portion of the travel of the lid between the closure configuration and the access configuration;

inserting a cosmetic article in the base by passing it between the insert and the base.

14. The method according to claim 13, wherein the friction type retainer includes at least two retention projections that are angularly spaced apart by at least 90° about an axis of the insert in the position engaged in the lid.

15. The method for producing a easing according to claim 13, further comprising:

closing the lid by moving it towards the closure configuration thereof.

16. The casing according to claim 1, wherein the base comprises a support stop, the insert comprises an abutment stop being configured to be arranged in abutment against said support stop in the lower position.

* * * * *